United States Patent [19]

Bradlee

[11] 4,298,633

[45] Nov. 3, 1981

[54] METHOD AND APPARATUS FOR TENSIONING METALLIC STRIPS ON A SLITTING LINE

[75] Inventor: Charles R. Bradlee, Sidney, Ohio

[73] Assignee: The Monarch Machine Tool Company, Sidney, Ohio

[21] Appl. No.: 161,186

[22] Filed: Jun. 19, 1980

[51] Int. Cl.[3] ..... B05C 9/10; B65H 23/04

[52] U.S. Cl. ..... 427/172; 118/33; 118/38; 427/178; 427/292; 427/156

[58] Field of Search ..... 118/33, 38, 39; 427/178, 292, 172; 242/56.2

[56] References Cited

U.S. PATENT DOCUMENTS

| | | | |
|---|---|---|---|
| 1,271,885 | 7/1918 | Freydberg | 118/38 |
| 2,726,051 | 12/1955 | Deuchert | 242/56.9 X |
| 3,685,711 | 8/1972 | Gay | 242/56.2 X |
| 3,771,738 | 11/1973 | Abbey | 226/195 X |
| 4,093,140 | 6/1978 | Matsunaga | 242/56.2 |

*Primary Examiner*—Evan K. Lawrence

*Attorney, Agent, or Firm*—Biebel, French & Nauman

[57] ABSTRACT

A method of tensioning metallic strips on a slitting line is combined with the steps of uncoiling a metallic web having a non-uniform cross sectional thickness from an uncoiler, slitting the web into a plurality of strips having varying thicknesses, and recoiling the strips into individual strip coils on a recoiler, the tensioning method being the additional step of depositing a strippable polymeric compound onto thinner strips so that the effective cross sectional thicknesses of the thinner strips is increased to that of the thicker strips so that the strip coils formed from the strips are of similar diameter and recoil the strips at the same rate, thereby preventing the formation of slack strips. The apparatus includes a hot melt unit for generating strippable plastic in liquid form, a hot melt gun communicating with the apparatus, a support frame and movable arm on which the gun is mounted, and a motor driving a rack and pinion for positioning the hot melt gun over a selected strip coil.

16 Claims, 11 Drawing Figures

METHOD AND APPARATUS FOR TENSIONING METALLIC STRIPS ON A SLITTING LINE

BACKGROUND OF THE INVENTION

1. Field of the Invention

The present invention relates to methods and apparatus for recoiling metallic strips on a slitting line, and more particularly to those methods and devices implementing steps or components for maintaining uniform tension in the strips as they are being recoiled.

2. Prior Art

Sheet metal produced by strip mills is typically sold in large, coiled rolls since the cost of producing sheet metal on a per pound basis varies inversely with the width of the sheet produced. Those purchasing these large coils and desiring to manufacture various products from the sheet metal find it necessary to have the sheet metal slit into narrow strips on a slitting line. The basic components of a slitting line are an uncoiler, on which is mounted the coiled sheet metal, a slitting machine having upper and lower rolls fitted with a plurality of knife edges which interact to slit the web from the coiled sheet metal into a plurality of strips, and a recoiler having a mandrel on which the slitted strips are recoiled into individual strip coils. In addition, a typical slitting line may contain a number of other components such as edge control devices to maintain the horizontal orientation of the web as it is being fed into the slitter, pinch rolls which facilitate the entry of the strip into the cutter, and drag wipes for maintaining proper tensioning of the strips as they are taken up on the recoiler.

A problem inherent in the operation of all slitting lines is caused by the variation in thickness across the width of the sheet. Present sheet metal forming processes result in sheet metal that is thinner at its longitudinal edges than at its center, resulting in a "crowned" contour or slight convexity across its width. As sheet metal having such a crowned contour is slit and recoiled into separate strip coils on the recoiler, the strips formed from the portion of the web adjacent its longitudinal edges are thinner than those formed from the center of the web.

Strip coils formed from the thinner outer strips do not increase in diameter at the same rate as those strip coils formed from the thicker center strips. For a given number of mandrel revolutions, the diameter of a strip coil made up of successive windings of thin strips will be less than one made up of successive windings of thick strips. The result is that, for each revolution of the mandrel on the recoiler, a shorter length of a thin strip is being wound onto its respective strip coil than that wound onto the thicker center coils. Since the metal web is fed into the slitter at the same rate across its width, this difference in recoiling rate results in a slackening of the thin strips from the slitter to the recoiler while the thicker strips remain properly tensioned. If a large coil of sheet metal is being slit on a slitting line, a considerable amount of slack strip is generated and results in fouling of the slitting line and danger to the personnel in the immediate area of the recoiler.

Many devices have been used in combination with a slitting line in order to compensate for the formation of slack strips between the slitter and the recoiler. For example, U.S. Pat. Nos. 3,771,738 and 3,685,711 disclose a tensioner having a pair of rollers used for maintaining tension between the tensioner and the recoiler, thereby insuring proper tensioning of the strips on the strip coils. However, this results in a slack strip condition between the device and the slitter. As a result, it is necessary to include a looping pit in combination with these tensioning devices so that the slack strips may drop down into the pit during the coiling operation. While the use of a looping pit and tensioning rolls is a simple expedient, the cost of excavating a looping pit is considerable and makes the relocation of the slitting line extemely impractical.

A second solution to the problem is disclosed in U.S. Pat. Nos. 4,093,140 and 2,726,051. These patents disclose slitting lines in which the strip coils are wound on individual drums mounted on the mandrel of a recoiler. The mandrel turns at a speed that exceeds that of any of the individual drums which slip relative to the mandrel. This permits a variation in the rotational speeds of the drums and eliminates slack strips. An inherent disadvantage of such systems is the complexity and expense of the specially designed recoiler and drums. In addition, if strips of varying sizes are to be cut by the slitter, it is necessary to change the width of the drums on the recoiler mandrel making it necessary to maintain a stock of drums of varying widths.

Another solution consists of inserting slips of paper into the nip of a strip coil formed from the thinner strips. The addition of paper between successive windings of the selected strip coil increases the diameter of the strip coil for a given number of windings so that it approximates that of a strip coil formed from the thicker center strips.

There are many disadvantages inherent in this method. Paper has become exceedingly expensive for such a use and would increase the cost of the slitting operation. In addition, any moisture contained in the paper would cause the strip it contacted to rust if the material slit was capable of rusting. There is also a danger of the paper combining with oil to stain the metal, which is undesirable when the metal is to be left unpainted and visible to the eye when incorporated with the finished product. And, in applications which the paper strips are inserted by hand, there exists the danger that the person injecting the paper may become mangled by the recoiler.

Accordingly, it is desirable to operate a slitting line in a fashion that eliminates the generation of slack strips between the slitter and the recoiler and does not require expensive looping pits, recoilers with separate drums, or the use of paper strips which increase cost and mar the product.

SUMMARY OF THE INVENTION

The present invention provides an improved method and apparatus for tensioning metallic strips on a slitting line in which the effective thickness of the thin outer strips is increased to that of the thick inner strips so that the strip coils formed from the strips are of similar diameter and recoil the strips at the same rate, thereby preventing the formation of slack strips between the slitter and the recoiler. The effective thickness of the thinner strips is increased by depositing on them a strippable polymeric compound in liquid form prior to the recoiling of the selected strip. As the thinner strip is recoiled with the strippable thermoplastic material, the material hardens and is held between successive windings of strips as they are coiled on the mandrel of the recoiler. The thickness of the polymeric compound is then added to the thickness of the thin strips to form a strip coil that is comparable in diameter to that of the coils formed from the thicker center strips. Since the strip coils have the same effective diameter during the recoiling operation, the length of metal strip recoiled into each strip coil for every revolution of the recoiler mandrel is the same. Therefore, the rate of take up of the slit strips is uniform across the width of the web and the production of slack strips is eliminated.

The method of the present invention is combined with a typical slitting method which includes the steps of uncoiling a metallic web having a non-uniform cross sectional thickness from an uncoiler, slitting the web by a slitter into a plurality of strips having varying thicknesses, and recoiling the strips into individual strip coils on a recoiler, the tensioning method consisting of depositing a strippable polymeric compound onto the thinner strips after the slitting step so that the effective cross sectional thickness of the thinner strips is increased, thereby preventing the formation of slack strips during operation of the recoiler. The strippable polymeric compound is preferably a polymer selected from the group consisting of ethylcellulose, cellulose acetate butyrate and polyethylene. To enhance strippability, the selected polymer can be combined with a suitable quantity of light machine oil. The polymeric compound can be deposited onto the thinner strips at an upper surface of the thinner strips just as they are being rewound into the strip coils, injected into the nip of the selected strip coil, or deposited on the upper surface of a selected strip after it has been wound onto the strip coil but before it has been overlapped by another winding of strip material.

The apparatus for performing the method of the invention is combined with typical slitting line apparatus such as an uncoiler for uncoiling a roll of coiled sheet steel having non-uniform cross sectional thickness, a slitter for slitting the sheet steel into a plurality of strips having varying thicknesses, and a recoiler for recoiling the strips into individual strip coils. The additional component consists of a hot melt applicator having a hot melt gun capable of being positioned adjacent a selected one of the thinner strips for depositing the polymeric compound thereon and means for positioning the gun adjacent a selected strip.

In the preferred embodiment of the invention, the hot melt applicator is mounted on a support frame having at least one pair of guides mounted thereon and includes an arm which slidably engages the guides and carries the hot melt gun which is fed by the applicator by means of an insulated hose. The arm is moved relative to the support frame by means of a rack and pinion arrangement; the rack is mounted on the upper surface of the arm and the pinion is attached to the drive shaft of a motor mounted on the support frame. The motor and a valve operating the hot melt gun are preferably remotely controlled from a single station so that a single operator can at once position the arm and thus the hot melt gun and activate the hot melt gun.

The support frame is preferably positioned adjacent the portion of the recoiler at which the strip is first taken up into the strip coils so that the hot melt gun can be positioned to deposit the polymeric compound onto the upper surface of the strips before they are coiled on the recoiler. Alternately, the support frame can be lowered and the hot melt gun adjusted so that it can be positioned to inject the compound into the nip of the selected strip coil. In a third position, the support frame is located adjacent the side of the recoiler opposite the slitter so that the polymeric compound is deposited onto the top of the strip after it has been taken up on the strip coil but before it is overlapped.

The hot melt applicator and the valve in the hot melt gun are preferably pneumatically operated and both can be operated from a single source of compressed air. The motor is preferably hydraulically operated, and can be driven by a small hydraulic power unit positioned conveniently on the support frame.

The controls for the hydraulic motor and pneumatic valve in the hot melt gun preferably are integrated onto a master control panel from which the entire slitting line is operated. Thus, a single operator can activate the slitting line and then, as needed, activate the hot melt apparatus to prevent slack strips from being generated by the slitter. The hazards of the operation and of the entire installation are decreased, and the manpower needs are minimized, since only one operator is required and he is positioned at a station removed from the immediate vicinity of the slitting line.

Operation of a slitting line incorporating the invention is not complicated. After the metal web has been unwound from a coil mounted on the uncoiler and properly threaded through the slitter and the resultant strips have been attached to the individual strip coils of the recoiler, the operator will activate the slitting line and the recoiling process will increase up to the full operating speed. As the outer strips begin to slacken between the slitter and the recoiler, the operator then activates the hydraulic motor which, through the rack and pinion, moves the arm to position the hot melt gun over a selected slack strip. The operator then activates the pneumatic valve in the hot melt gun and a stream of strippable polymeric compound is deposited on the strip. After the compound is deposited on the strip, it hardens and is recoiled into the individual strip coil; the thickness of the compound adding to the thickness of the thinner strips to increase the effective thickness of the strip and maintain a diameter of the strip coil equivalent to that of the strip coils made up of the inner thicker strips. The slackness being removed from one selected strip, the operator can then reposition the hot melt gun by activating the hydraulic motor to deposit the strippable compound on a second selected strip, usually one formed from a portion of the web proximate its outer longitudinal edge.

A slitting line incorporating the invention can be used to slit coils of such materials as steel, aluminum, brass, copper, and stainless steels. Galvanized metals, which may vary in thickness randomly across the width of the web, could require plastic injection at any strip coil, so it is necessary that the arm be designed to travel the full width of the recoiler.

The slitting line of the present invention possesses several advantages over prior art slitting lines. The generation of slack strips between the slitter and the recoiler is prevented by the hot melt applicator apparatus and thereby eliminates the need for looping pits, thus greatly reducing the overall cost of the installation and the safety hazards attendant with the presence of a looping pit in the shop floor. In addition, the method and apparatus of eliminating the slack strips does not have the inherent safety hazards of other methods, such as manually inserting paper strips into the nip of the strip coils. The entire operation can be orchestrated from a single console in which the operator can both adjust the speed and action of the slitting line and position and activate the hot melt applicator and hot melt gun.

Accordingly, it is an object of this invention to provide a slitting line in which the generation of slack strips by the slitter is compensated for in the recoiling operation; to provide a method and apparatus for preventing the generation of slack strips which is inherently safe for an operator of the slitting line; and to provide a method and apparatus for eliminating the generation of slack strips which is relatively inexpensive and can be retrofitted onto existing slitting lines.

Other objects and advantages of the invention will be apparent from the following description, the accompanying drawings and the appended claims.

DETAILED DESCRIPTION OF THE PREFERRED EMBODIMENT

Figure 1:
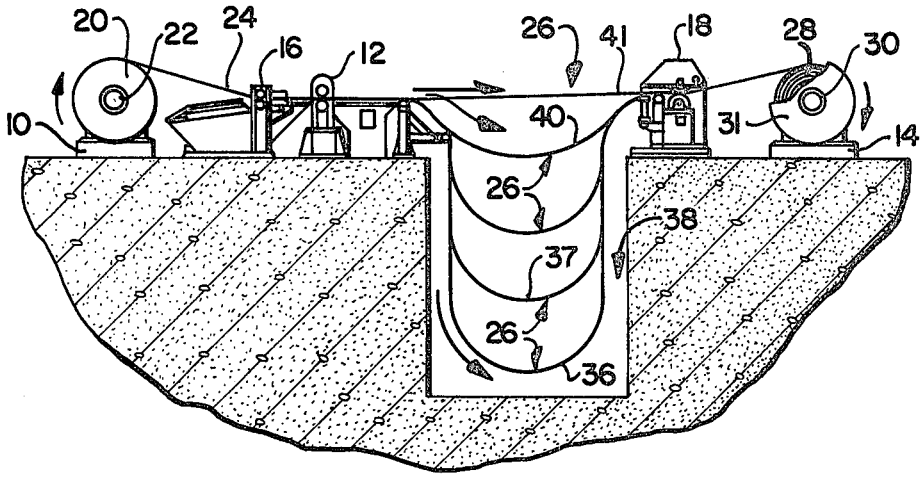
FIG-1 PRIOR ART
FIG. 1 is a somewhat schematic side elevation of a slitting line of the prior art, including a looping pit.

For the purposes of background, FIG. 1 shows somewhat schematically a conventional slitting line which includes an uncoiler 10, slitter 12, and recoiler 14. The prior art slitting line may include other components such as pinch rolls 16 to facilitate entry of the strip into the cutter and tensioning apparatus 18 to maintain the tension of the strips being recoiled. In accordance with accepted practice, a coil 20 of sheet metal or the like is placed upon an unwind mandrel 22 and a web 24 is uncoiled from the coil and trained through the slitter 12. The web 24 is slit by the slitter 12 into a plurality of strips 26 which are recoiled into individual strip coils 28 mounted on a mandrel 30 and separated by discs 31, all forming part of the recoiler 14.

Figure 2:
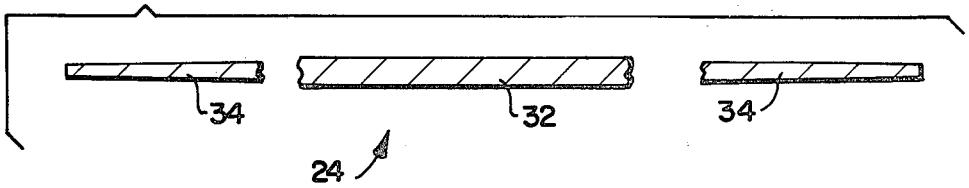
FIG. 2 is a fragmented view of an end section of a metal web showing portions adjacent the longitudinal edge of the metal web and a portion from the center of the metal web.

As shown in FIG. 2, an end section of web 24 deviates from a perfect rectangular configuration. The center portion 32 of the web 24 has a thickness greater than that of the side portions 34 adjacent the longitudinal edges of the web 24. Typically, on a web 24 having a center portion as thick as 0.060 inches the side portions 34 could be as thin as 0.058 inches. A web 24 having an end configuration such as that depicted in FIG. 2 is said to have a "crowned" contour since the cross sectional profile of the web shows a slight convexity.

As a web 24 having a crowned contour is passed through and cut by a slitter of a typical prior art slitting line and the individual strips 26 generated are rewound into individual strip coils 28 on the recoiler 14, the strip coils composed of the strips from the side portions 34 of the web do not increase in diameter as rapidly as those strip coils composed of strips from the center portion 32 of the web since, for every revolution of the recoiler, the diameter of the strip coils made up of thinner strips is increased by a lesser amount. Therefore, for each revolution of the recoiler, a shorter length of strip 26 is recoiled onto those strip coils 28 consisting of the side portions 34 of the web 24 than the length of strip recoiled onto those strip coils consisting of the center portion 32 of the web. The result is that outer strips, as at 36 and 37 become slack between the slitter 12 and the recoiler 14 and must be retained by means such as a looping pit 38. The inner strips as at 40 and 41, however, are not slack and can be recoiled tightly by the recoiler 14. Tensioning apparatus 18 is often used to maintain uniform tension of the strip coils 28. However, this tends to worsen the problem of slack outer strips 36, 37.

Figure 3:
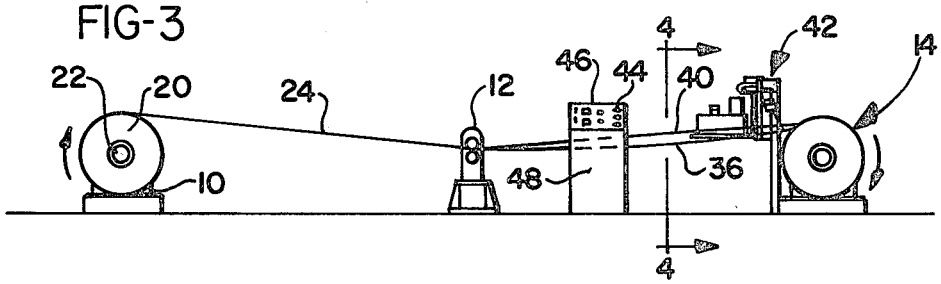
FIG. 3 is a side elevation of a slitting line embodying the invention.

As shown in FIG. 3, the slitting line of the present invention basically includes an uncoiler 10, slitter 12, and recoiler 14, but does not require means such as looping pit 38 to compensate for the generation of slack strips. The slitting line of the present invention also includes a hot melt depositing apparatus, generally designated 42, which is positioned between the slitter 12 and the recoiler 14 adjacent the recoiler. The controls 44 for the hot melt depositing apparatus 42 can be integrated into a common control panel 46 for the entire line at a single operator station 48.

The depositing apparatus 42 is best shown in FIGS. 4, 5, 6, and 7. A hot melt unit 50 is mounted on a frame 52 which can be bolted to the base 54 of the recoiler 14. The hot melt unit 50 communicates with a hot melt gun 56 by means of a heated conduit 58. The hot melt unit 50 is well-known in the art and is available in a variety of designs and capacities. The hot melt unit 50 of the preferred embodiment must be capable of receiving a quantity of polymeric compound, heating the compound to a liquid state, and conveying the compound to the gun 56 by means of the insulated conduit 58. Similarly, the gun 56 and insulated conduit 58 are well-known in the art.

The hot melt gun 56 includes a pneumatic valve 60 located between an air supply line 62 and the gun supply line 64. The air supply line 62 is connected to a source of compressed air (not shown) and also may be used to charge the hot melt unit 50 through hot melt supply line 66 to enable the hot melt material to be propelled through the insulated conduit 58. The pneumatic valve 60 is electrically powered and receives its power from a control panel 68 by means of an electrical conduit 70. Control panel 68 is activated by controls 44 and connected to control panel 46 by suitable means (not shown). Thus, when valve 60 is activated and air from supply line 62 pressurizes gun supply line 64, a normally closed valve in gun 56 is opened, permitting a quantity of compound to flow from conduit 58 through the gun.

The support frame 52 has an upper cross member 72 which supports a mounting consisting of an angle member 73 having one leg attached to an arch-shaped member 74, with a motor 75 secured to the outer leg of member 73. Motor 75 is connected to a hydraulic power unit 76 consisting of an electric motor driven pump 78 and reservoir 80. Hydraulic lines 82 connect the hydraulic motor 75 with the reservoir 80.

Upper cross member 72 also supports an arm 84 which slidably engages two pairs of guides 85, 86. Guides 85 are attached to a first arch-shaped member 74 and guides 86 are attached to a second arch-shaped member 87 enclosed by shroud 88. The second arch-shaped member 87 and shroud 88 are mounted to the upper cross member 72. A rack 89 is fastened to the top of arm 84 and engages a pinion 90 mounted on the drive shaft of the hydraulic motor 75. Limit switches 92 are positioned on the upper cross member 72 adjacent the hydraulic motor 75 and are an integral part of a control circuit within control panel 46. Knobs 93 protrude from arm 84 to activate switches 92 thereby shutting off motor 75 when the arm 84 has extended or retracted to a predetermined point.

Figure 7:
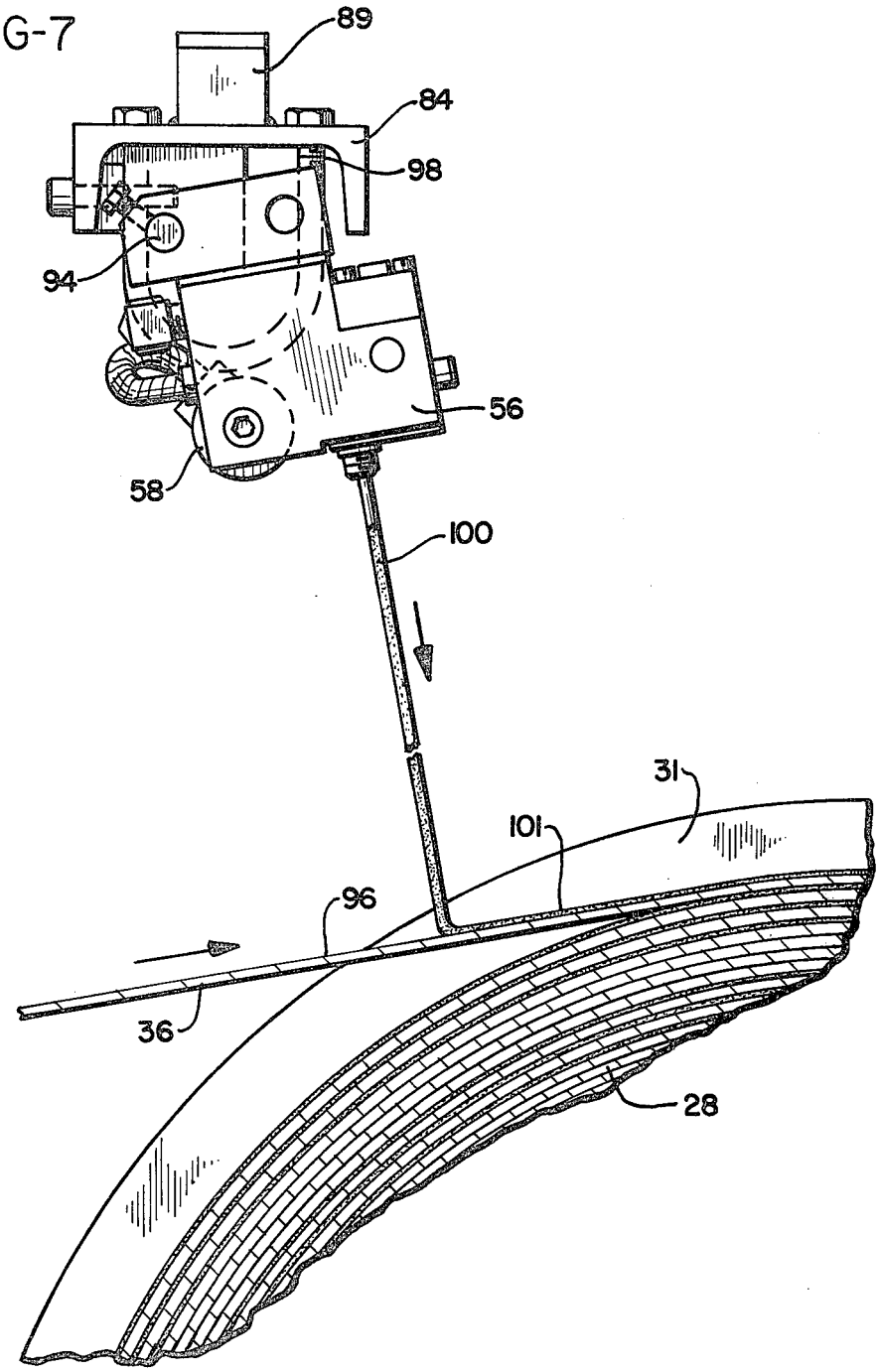
FIG. 7 is an end view taken on line 7—7 of FIG. 4 and showing the hot melt gun and a fragment of a strip coil treated in the method of the invention.

Hot melt gun 56 is attached to the end of arm 84 by a bracket 94 and, in the preferred embodiment, is directed downwardly toward the upper surface 96 of an outer strip 36 (see FIG. 7). The heated conduit 58 which feeds hot melt gun 56 from a reservoir within hot melt unit 50 and the pneumatic gun supply line 64 which extends to the hot melt gun from pneumatic valve 60 are carried beneath arm 84 by U-bolts 98. Heated circuit 58 and gun supply line 64 form a loop beneath upper cross member 72 which extends away from strip coils 28 as arm 84 is retracted toward frame 52 to avoid fouling of the recoiling operation by the conduit and supply line.

Figure 8:
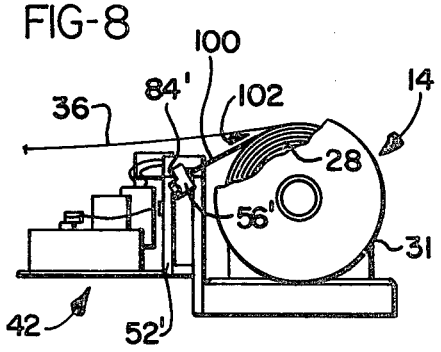
FIG. 8 is an alternate embodiment of the invention.
Figure 4:
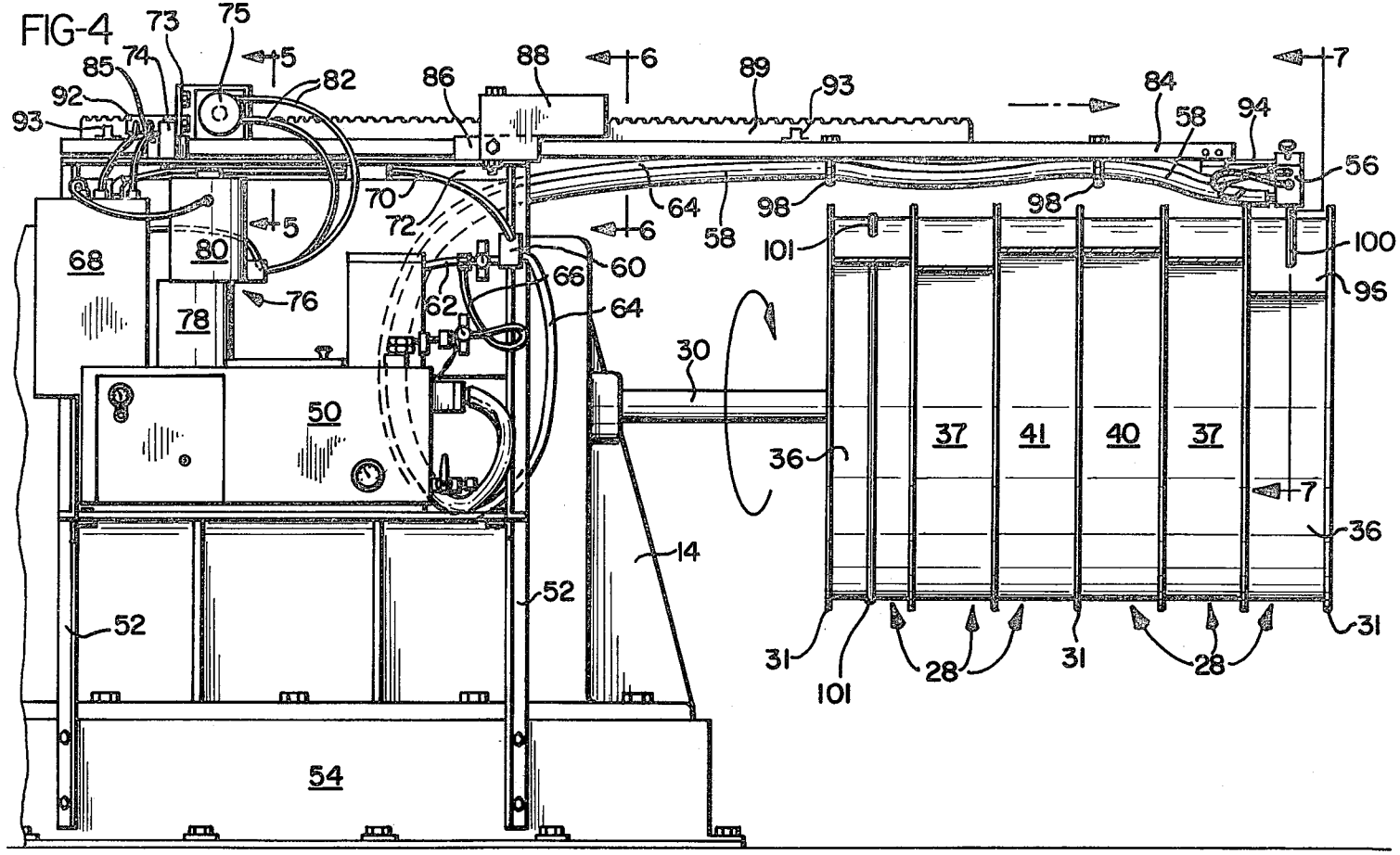
FIG. 4 is an elevation of the apparatus of the invention taken at line 4—4 of FIG. 3.
Figure 5:
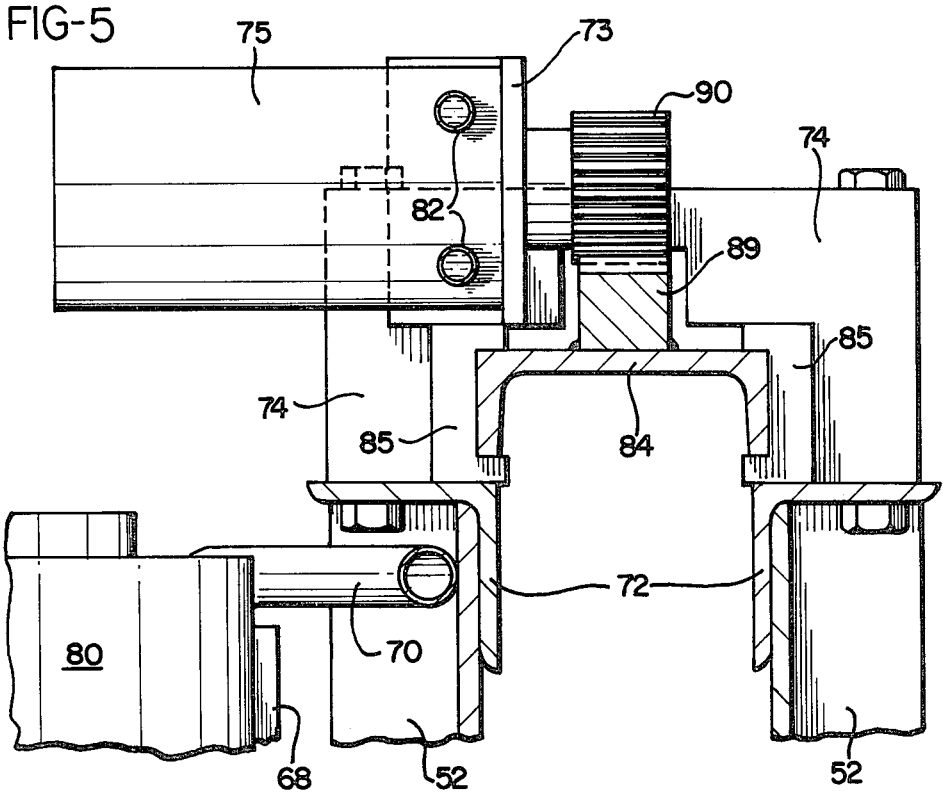
FIG. 5 is a section of the apparatus of FIG. 4 taken at line 5—5.
Figure 6:
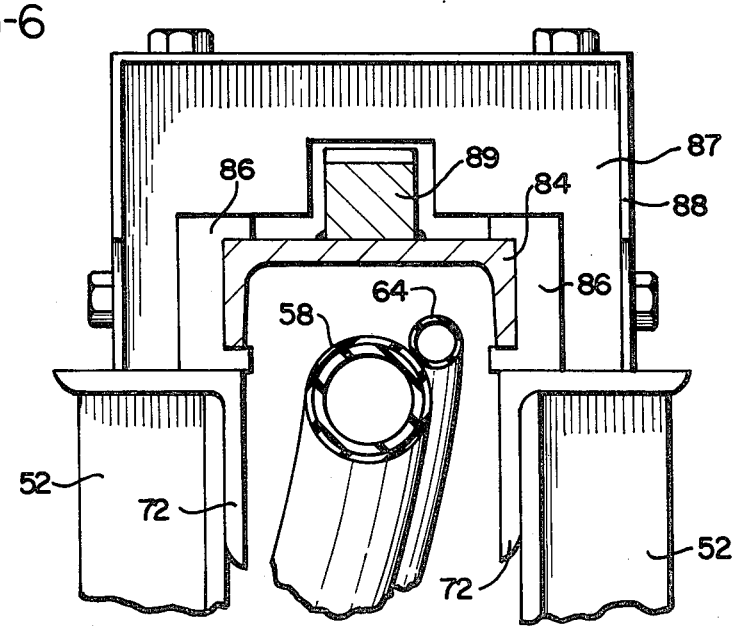
FIG. 6 is a section of the apparatus of FIG. 4 taken at line 6—6.

In the preferred embodiment, as shown in FIGS. 3, 4, and 7, frame 52 is of sufficient height so that arm 84 extends over the top of the strip coils 28 so that the polymeric compound 100 can be deposited as a bead 101 on the upper surface 96 of strip 36 prior to the coiling of the strip. However, as shown in FIG. 8, frame 52' can be shortened so that arm 84' is positioned to extend or retract along the nips 102 of the strip coils 28. Hot melt gun 56' is pivoted on its bracket so that the liquid polymeric compound 100 is injected into the nip 102 of the selected strip coil 28.

Figure 9:
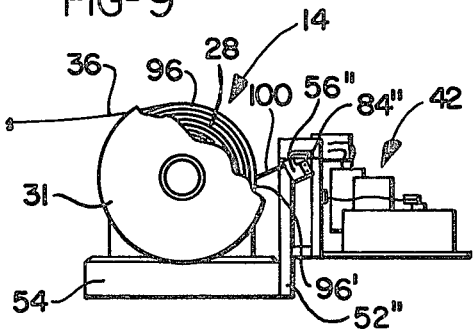
FIG. 9 is a second alternate embodiment of the invention.

In another embodiment, shown in FIG. 9, the frame 52'' is mounted to base 54 of recoiler 14 on the outside of the slitting line. Arm 84'' is positioned on frame 52'' so that the hot melt gun 56'' can deposit the polymeric compound 100 onto the upper surface 96 of a selected outer strip 36 after it has been coiled onto the respective strip coil 28 but before it has been overlapped by successive lengths of outer strips 36.

Figure 10:
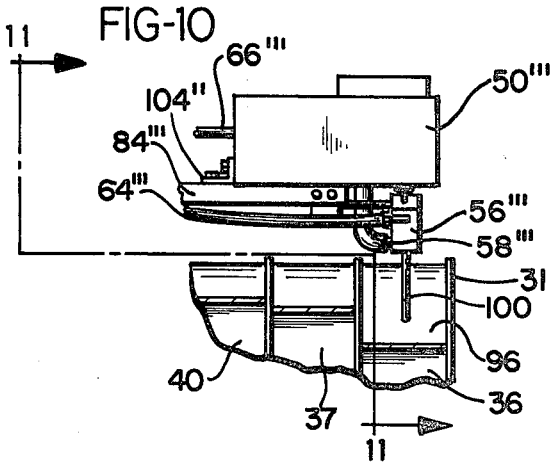
FIG. 10 is a third alternate embodiment of the invention.
Figure 11:
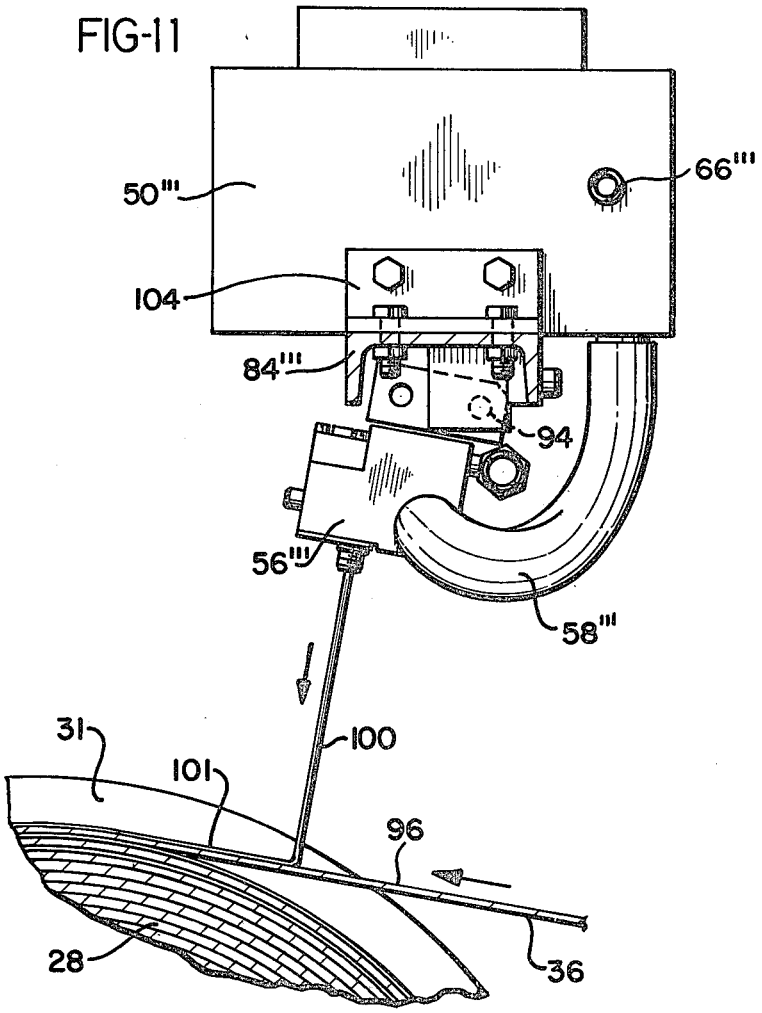
FIG. 11 is a view of the embodiment of FIG. 10 taken at lines 11—11.

In a third embodiment, shown in FIGS. 10 and 11, a smaller hot melt unit 50''' is mounted on the end of arm 84''' by mounting plate 104 above bracket 94''' and hot melt gun 56''' instead of on the frame. Hot melt gun 56''' is fed by heated conduit 58''' from the hot melt unit 50''' and the on/off valve within the gun is activated by supply line 64'''. Hot melt unit 50''' is activated by hot melt supply line 66''' in a manner similar to that shown in FIG. 4 for hot melt supply line. Air flow through supply line 64''' is controlled by an electrical solenoid valve on the frame, and both supply lines 64''', and 66''' are fed by an air supply line, all in a manner similar to that of the comparable elements shown in FIG. 4.

In this fashion, hot melt unit 50''40 travels with the gun 56''' on arm 84''' and eliminates the need for heated hose 58''' to extend the length of the arm and thereby eliminates stress fatigue that might occur to the heated hose caused by repeated extensions and retractions of the arm. Supply lines 64''', 66''' can be secured beneath arm 84''' by suitable means such as U-bolts.

For all four embodiments, the operation of the slitting line and hot melt unit 50 is essentially the same. After a coil 20 of sheet metal has been mounted on the unwind mandrel 22 of uncoiler 10, a web 24 is unwound and fed into slitter 12. After the slitter has been activated and the web is slit into strips 26, the strips are fed into individual strip coils 28 separated by discs 31 or other known means and carried on rewind mandrel 30 of recoiler 14 (see FIG. 3).

Continued operation of the slitting line results in the generation of slack outer strips 36 and taut inner strips 40, resulting from variations in cross sectional thickness of web 24 as explained previously. An operator standing at operator station 48 then implements controls 44 first to activate motor 75 so that rotation of pinion 90 causes rack 89 and arm 84 to extend outwardly from frame 52 to position hot melt gun 56 above a selected outer strip 36 which is beginning to sag between slitter 10 and recoiler 14 (see FIGS. 3 and 4). The operator can then activate hot melt unit 50 and open pneumatic valve 60 to activate gun 56 to squirt the liquid polymeric compound 100 onto the upper surface 96 of selected outer strip 36.

As shown in FIG. 7, continued deposition of polymeric compound 100 onto selected outer strip 36 results in a strip coil 28 made up of successive layers of outer strips 36 and beads 101 of polymeric compound 100. Thus, the effective thickness of the selected outer strip 36 is increased and the resulting strip coil 28 has a diameter, for a given number of revolutions of rewind mandrel 30, similar to that of a strip coil made up of inner strips 40 (see FIGS. 4 and 7). The aforementioned process can be repeated for various strip coils 28 made up of outer strips 36, as needed.

Preferably, the hot melt compound is a strippable polymer selected from the group consisting of ethylcellulose, cellulose acetate butyrate, and polyethylene. Such materials harden rapidly and are easily removed as the coils are uncoiled. Due to the inherent nature of the polymer compounds, the flattened beads fall off of the strips as they are uncoiled by the ultimate user. No damage or marring of the strips results. In some instances, it is desirable to mix a quantity of machine oil with the hot melt material to increase the strippability of the hardened hot melt material.

The above description of the method and apparatus of the invention demonstrates the safety and economy of those slitting lines implementing the invention. All phases of the hot melt depositioning process can be controlled from an operator station from which the other operations of the slitting line can be controlled. Thus, only a single operator is necessary during the slitting operation.

In addition, the single operator is removed a safe distance from the operation of the slitting line thereby reducing the danger of the operator being injured by the operation of the various components of the slitting line.

While the forms of apparatus herein described constitute preferred embodiments of this invention, it is to be understood that the invention is not limited to these precise forms of apparatus, and that changes may be made therein without departing from the scope of the invention.

What is claimed is:

1. In combination with a metal slitting operation including the steps of uncoiling a web having a non-uniform cross sectional thickness from a metal coil, slitting said web into a plurality of strips having varying thicknesses and recoiling said strips into individual strip coils, the method of tensioning strips comprising the step of:

depositing a flowable material onto thinner strips after said slitting step and hardening said material during said recoiling step such that said material is overlapped by successive windings of said thinner strips, the amount of flowable material deposited being such as to increase the effective cross sectional thickness of said thinner strips so that all strip coils are of comparable diameter, thereby eliminating slackness in said strips.

2. The method of tensioning strips of claim 1 wherein said flowable material is a thermoplastic material.

3. The method of tensioning strips of claim 1 wherein said thermoplastic material is a strippable polymeric compound.

4. The method of tensioning strips of claim 1 wherein said material is deposited on an upper surface of said thinner strips.

5. The method of tensioning strips of claim 1 wherein said material is deposited onto said thinner strips at the nip of their respective strip coils.

6. The method of tensioning strips of claim 1 wherein the step of depositing said material includes the step of positioning a means for depositing said compound proximate a selected one of said thinner strips, then depositing the material on said selected thinner strip.

7. An improved slitting line of the type having an uncoiler for uncoiling a metal web from a roll of coiled sheet metal having a non-uniform cross sectional thickness, a slitter for slitting said web into a plurality of strips having varying thicknesses, and a recoiler for recoiling said strips into individual strip coils, the improvement comprising:

means for depositing a flowable compound onto thinner strips so that the effective cross sectional thickness of said thinner strips is increased so that all strip coils are of comparable diameter, thereby eliminating slackness in said thinner strips between said slitter and said recoiler.

8. The slitting line of claim 7 wherein the improvement further comprises means for positioning said depositing means proximate a selected one of said thinner strips.

9. The slitting line of claim 8 wherein said depositing means includes a hot melt applicator having a hot melt gun communicating therewith and proximate said thinner strips.

10. The slitting line of claim 9 wherein said positioning means includes:

a support frame;

at least one pair of guides mounted on said frame;

an arm having said hot melt gun mounted thereon and slidably engaging said guides; and means for moving said arm relative to said frame such that said hot melt gun is positioned to deposit said compound onto said selected thinner strip.

11. The slitting line of claim 10 wherein said means for moving said arm includes:

a rack mounted on said arm;

a pinion engaging said rack and a motor driving said pinion;

a first control for activating said motor thereby causing said pinion to move said rack and said arm relative to said frame to position said hot melt gun to deposit said compound onto said selected thinner strip; and a second control, integral with said first control, for activating said hot melt applicator when said hot melt gun is positioned proximate said selected thinner strip.

12. The slitting line of claim 10 wherein said support frame is positioned relative to said recoiler such that said arm extends from said frame above said strip coils and said hot melt gun deposits said compound downwardly therefrom onto the upper surface of a strip coil corresponding to said selected thinner strip.

13. The slitting line of claim 10 wherein said support frame is positioned relative to said recoiler such that said arm extends from said frame proximate the nips of said strip coils and said hot melt gun deposits said compound into a nip of a strip coil corresponding to said selected thinner strip.

14. The slitting line of claim 13 wherein said hot melt applicator includes means for delivering a pressurized stream of said compound from said hot melt gun.

15. The slitting line of claim 10 wherein said support frame is positioned relative to said recoiler such that said arm extends from said frame proximate an exterior side of said recoiler opposite the side facing said slitter and said hot melt gun deposits said compound on said exterior side of a strip coil corresponding to said selected strip.

16. The slitting line of claim 7 wherein said flowable compound is a strippable polymeric compound selected from the group consisting of ethylcellulose, cellulose acetate butyrate, and polyethylene.

* * * * *